US008720535B2

(12) United States Patent
Saumweber et al.

(10) Patent No.: US 8,720,535 B2
(45) Date of Patent: May 13, 2014

(54) HEAT EXCHANGER, USE, AND MANUFACTURING PROCESS FOR A HEAT EXCHANGER

(75) Inventors: Christian Saumweber, Stuttgart (DE); Stefan Schill, Renningen (DE)

(73) Assignee: Behr GmbH & Co. KG, Stuttgart (DE)

( * ) Notice: Subject to any disclaimer, the term of this patent is extended or adjusted under 35 U.S.C. 154(b) by 967 days.

(21) Appl. No.: 12/538,298

(22) Filed: Aug. 10, 2009

(65) Prior Publication Data

US 2010/0038063 A1 Feb. 18, 2010

(30) Foreign Application Priority Data

Aug. 8, 2008 (DE) ..... 10 2008 036 975
Oct. 16, 2008 (DE) ..... 10 2008 051 896

(51) Int. Cl.
*F28F 9/02* (2006.01)
*F28F 9/04* (2006.01)
*B29D 29/06* (2006.01)

(52) U.S. Cl.
USPC ..... 165/173; 165/178; 29/890.043

(58) Field of Classification Search
USPC ..... 165/173, 178; 29/557, 890.04, 890.043, 29/890.044; 285/201–203, 124.1, 124.2, 285/124.3, 289.1–289.5, 374, 399
See application file for complete search history.

(56) References Cited

U.S. PATENT DOCUMENTS 2,460,666 A * 2/1949 Wurzburger ..... 285/21.1
3,796,258 A * 3/1974 Malhotra et al. ..... 165/151
4,150,556 A 4/1979 Melnyk
5,092,397 A 3/1992 Fuhrmann et al.
5,490,560 A * 2/1996 Helms et al. ..... 165/173
5,918,667 A * 7/1999 Chiba et al. ..... 165/178
6,263,570 B1 * 7/2001 Cazacu ..... 29/890.043
7,413,006 B2 * 8/2008 DeGroot et al. ..... 165/173
2003/0000087 A1 * 1/2003 Geiman et al. ..... 29/888.092
2005/0051319 A1 * 3/2005 Crook ..... 165/178
2007/0000657 A1 * 1/2007 Emrich et al. ..... 165/173
2007/0235175 A1 * 10/2007 DeGroot et al. ..... 165/173

FOREIGN PATENT DOCUMENTS

DE 33 16 960 A1 11/1983
DE 39 10 357 A1 10/1990
DE 41 12 431 A1 10/1992
DE 197 57 034 A1 6/1999
DE 100 16 029 A1 10/2001
DE 10016029 A1 * 10/2001
DE 103 43 239 A1 4/2005
DE 10 2007 059 673 A1 8/2008

(Continued)

*Primary Examiner* — Allen Flanigan
*Assistant Examiner* — Jason Thompson
(74) *Attorney, Agent, or Firm* — Muncy, Geissler, Olds & Lowe, P.C.

(57) ABSTRACT

A heat exchanger includes a block for the separated and heat-exchanging guiding of first and second fluids, the block having a number of fluid flow channels, at least one box which is flow-connected to the flow channels, and at least one base that includes one or more openings for feeding the flow channels from the box. At least one opening is formed as a passage with a collar having a near-bottom section and an end-side section, and a wall thickness of the end-side section is smaller than a wall thickness of the near-bottom section. A shoulder between the near-bottom and end-side section has a contour running transverse to the contour of the near-bottom section and/or the end-side section, and the end-side section is inclined away from a passage axis. Also a manufacturing process for a heat exchanger.

28 Claims, 6 Drawing Sheets

(56) References Cited

FOREIGN PATENT DOCUMENTS

| | | | |
|---|---|---|---|
| FR | 2 421 357 | A1 | 10/1979 |
| FR | 2 764 054 | A1 | 12/1998 |
| GB | 169855 | | 10/1921 |
| GB | 2 055 0564 | A | 2/1981 |
| JP | 11-51592 | | 2/1980 |

* cited by examiner

HEAT EXCHANGER, USE, AND MANUFACTURING PROCESS FOR A HEAT EXCHANGER

This nonprovisional application claims priority under 35 U.S.C. §119(a) to German Patent Application No. 10 2008 036 975.6, which was filed in Germany on Aug. 8, 2008, and to German Patent Application No. 10 2008 051 896.4, which was filed in Germany on Oct. 16, 2008, and which are both herein incorporated by reference.

BACKGROUND OF THE INVENTION

1. Field of the Invention

The present invention relates to a heat exchanger for heat transfer between a first fluid and a second fluid, that includes: a block for the separated and heat-exchanging guiding of the first and second fluid, the block having a plurality of flow channels through which the first fluid can flow; at least one box which is assigned to the block and which is flow-connected to the flow channels; and at least one base, which is provided with one or more through openings for feeding through the flow channels between the block and the box. Whereby at least one through opening is formed as a passage with a collar. The invention relates further to a use of the heat exchanger and to a manufacturing process.

2. Description of the Background Art

Heat exchangers, particularly in mobile applications, are generally made as tube-corrugated fin systems. The block of such a heat exchanger of the aforementioned type has, e.g., a so-called radiator network of an alternating superposing of tubes and heat-transferring corrugated fins. In the aforementioned case in particular, a heat exchanger is exposed to especially high stochastic alternating pressure and thermal stress. The noted alternating stress is critical for the lifetime of a heat exchanger. The alternating thermal stress in a heat exchanger of the aforementioned type is the dominant type of stress because of the especially high mechanical stress amplitudes resulting in the area of the tube ends. It turned out that there is almost always a nonhomogeneous temperature distribution within the block with a nonhomogeneous thermal expansion distribution assigned directly to it, the latter results in strain in the block. In this case, it is of critical importance that the thermal expansion differences within the block can occur not only in a tube lengthwise direction but as a rule also exist transverse thereto. It has become clear in particular that for the corner tubes of the radiator network, this results in relatively great bending deformations in the area of the base connection with the assigned relatively high stresses. Thus, e.g., along the tube circumference the highest stresses in a flat tube can be found in the area of the transition from the tube narrow side to the tube wide side, i.e., in the area of the corner radii. If stresses at the tube base connections in the area of the corner radii or the transition from the tube narrow side to the tube long side are successfully minimized, this can increase the lifetime of the heat exchanger.

A heat exchanger of the aforementioned type with an improved tube-base connection is illustrated is applications by the applicant, for example, German Patent Applications Nos. DE 197 57 034 A1 or DE 103 43 239 A1, which corresponds to U.S. Publication number 20070000657, and which are all herein incorporated by reference. It is proposed as a concept therein to use inverted passages with a collar oriented toward the radiator network, particularly for mobile applications. Improvement of the force flow by reducing the so-called bottom projection, as it is explained with use of FIG. 1B as half the difference between the tube depth t and base depth T, can be used advantageously thereby to increase the internal pressure fatigue strength.

It is known, for example, from British Pat. No. GB 169,855, to secure tube ends in a heat exchanger in a passage. To this end, GB 169,855 discloses a passage with a collar, which at its end facing away from a base plate has a tooth-like contour formed by tongues, the contour in which a tube end is secured flexibly and resiliently.

The mentioned tongues achieve a local lengthening of the passage and are used to equalize an abrupt change in the section modulus in the area of the tube-base connection, in order to take into account possible suddenly occurring changes in the cross section of a tube. In fact, this results in a more flexible and elastic securing of tubes in the area of the passage—the latter, however, leads only to an overall strain relief of a tube-base connection, without counteracting the specific stresses in the area of the corner radii of the tube-base connection.

Likewise, German Unexamined Patent Application No. DE 33 16 960, U.S. Pat. No. 4,150,556, and Japanese Pat. No. JP 11051592 A, disclose other options for a passage with a step-like, in sections linear collar contour for accommodating a flat tube, which in turn can only achieve an overall mechanical improvement for securing a flat tube.

German Patent Application No. DE 39 10 357 A1, which corresponds to U.S. Pat. No. 5,092,397 discloses a passage which to accommodate a heat exchanger tube has a particular raised collar with an oval profile. To avoid cracks in the collar, particularly at large ratios of the largest diameter to the smallest diameter of the same, the collar in the region of its small radii has a smaller height than in the region of its larger radii. As a result, the tearing of the collar is largely eliminated, without a substantial performance reduction of the heat exchanger, also described therein, having to be taken into consideration. A substantially step-like, in sections linear collar contour is also proposed there. This type of heat exchanger merits improvement particularly with respect to problems arising with an internal pressure change and/or temperature change due to tension- and bending-causing stresses.

Overall, these and other approaches generally have the disadvantage that the aim is a one-sided improvement of thermal shock resistance by a relatively thicker or specially designed contour of the passage and/or its collar. In this regard, the requirements necessary for process-secure fabrication, particularly for rather large radiator networks, relating to the process-secure insertion of heat exchanger tubes into the base, are generally neglected. It has proven advantageous to provide an insertion taper as is disclosed, by way of example, in German Patent Application No. DE 100 16 029 A1. In this case, it turned out that the size of the insertion taper for the tubes in the passage or in the collar is limited by the material thickness of the collar. The attempt to resolve the conflict of goals occurring in practice between the collar thickness minimization, sought for reasons of improved thermal shock resistance, and the insertion taper maximization, desired for achieving the greatest possible process security, in DE 100 16 029 A1 in a first approach is to simply curve the collar outward. This simplified approach, however, disadvantageously results inevitably in a relatively great reduction in the contact area between the tube and base, which in turn leads to loss of strength. This circumstance in particular is still worthy of improvement.

It is therefore desirable to improve the durability in a heat exchanger and to simultaneously improve the conditions for a process-secure automated fabrication.

SUMMARY OF THE INVENTION

It is therefore an object of the present invention to provide a heat exchanger, in which the durability is improved and a fabrication process is designed more secure and/or simpler. It is also an object of the invention to provide a heat exchanger in which the collar of a passage creates improved conditions for a process-secure and automated fabrication by means of an insertion taper for a tube and, nevertheless, has a strength advantage, particularly in an advantageous improvement vis-à-vis DE 100 16 029 A1.

The object is achieved by the invention with a heat exchanger, in which according to the invention the collar, on at least one side, has a near-bottom section and an end-side section, whereby a wall cross section of the end-side section is smaller than a wall cross section of the near-bottom section; and between the near-bottom and end-side section at least one shoulder is disposed, which has a shoulder contour running transverse to the contour of the near-bottom section and the end-side section; and whereby the end-side section is inclined away from a passage axis.

The collar can have sections of the invention on all sides, i.e., be provided with the sections of the invention circumferentially. It can also prove advantageous to provide the sections of the invention only on opposing sides of the collar, e.g., on the long sides or short sides of the collar (in the case of flat tubes), or only on two adjacent sides of the collar. A section of the invention can also be provided only on one or only on three sides of the collar.

All through openings of the base can be made as a passage with a collar. Only one part of the through openings as well can be formed advantageously according to the invention. The formation of the through openings according to the invention in particular at the edge or corner regions of the base has proven advantageous for edge or corner regions.

The invention proceeds from the consideration that, as mentioned heretofore, a continuously decreasing wall thickness, as provided in DE 100 16 029 A1, from the start of a passage to its end and a simple outward bending of the collar has strength disadvantages, because the contact area between the tube and base is reduced and because the passage is to be made relatively thin at the lower end and thereby entails strength disadvantages. Proceeding from this consideration, the invention has realized that it should be possible to provide an insertion taper in the case of a collar, i.e., to design a collar as bendable, and yet for increased strength provide a sufficient bearing surface between the collar and tube in a passage. Accordingly, the invention provides that the collar has discernible sections, namely, a near-bottom section and an end-side section, between which as a discernible separation between the sections at least one shoulder is disposed, which has a shoulder contour running transverse to the contour of the near-bottom section and the end-side section. The invention has realized that it is possible by means of this measure in an advantageous manner to incline the end-side section away from a passage axis and thereby yet provide sufficient bearing surface between the collar, particularly the near-bottom section, and the tube. In other words, according to the concept of the invention, a relatively longer and thinner collar in the end-side section is provided. Moreover, there is to be a relatively strong, dimensionally stable near-bottom section of the collar. This section can be made in particular thicker than the end-side section.

Overall, as a result, the conflict of goals between as great an insertion taper as possible and increased strength of the tube-base connection is resolved in a better way. The solution is essentially accomplished by the transverse shoulder contour, which forms in particular the predominant wall cross section difference between the near-bottom section and the end-side section. A cross-sectional change, achieved thereby, particularly limited to a relatively small space, namely, that of the shoulder, therefore represents a change in the section modulus, provided in a limited space. As a result, in an advantageous manner, on the one hand, the position of the cross section change is defined as the position at which a collar buckles outward. On the other hand, a relatively thinner collar and longer collar can be easily bent by the end-side section. In addition, the near-bottom section can be made especially dimensionally stable and relatively materially strong. In other words, overall the collar can be made with improved process security and a strength advantage. In particular, the size of the insertion taper can be influenced by the concept of the invention, for example, by the size of the shoulder design, and adjusted according to the intended application. In this case, it is basically assured that the cross section of the wall of the collar increases toward the radiator network, particularly discontinuously section by section. Overall, insertion tapers can be produced that are clearly larger than the insertion tapers limited by the material thickness of the collar according to state of the art.

The invention also leads to a manufacturing process in which, according to an embodiment of the invention, a shoulder with a transverse shoulder contour is provided, in particular stamped in.

In an embodiment of the invention, the transverse shoulder contour can be made in such a way that the predominant wall cross section difference between the near-bottom section and the end-side section is formed thereby. In other words, a predetermined buckling point is virtually placed in position by the transverse shoulder contour. This assures that, on the one hand, the end-side section of the collar is made relatively long and thin with the advantages of easy bendability. On the other hand, the near-bottom section of the collar is virtually not affected by the bending process and can thereby be formed lying sufficiently against the tube. The conflict in goals between improved collar strength and improved process security in an automated fabrication process is resolved in an especially advantageous way by this measure.

In an embodiment, a discernible, i.e., evident boundary between the shoulder and the end-side section can be defined by the transverse shoulder contour in the form of an inclination point, so that the end-side section inclines away from the passage axis in the finished passage. Within the scope of manufacture, the boundary corresponds practically to a buckling and/or bending point in the collar. In an advantageous manner, to this end, a greatest change in the wall cross section occurs at the discernible boundary between the end-side section and the shoulder. In other words, a transition between the end-side section and the at least one shoulder is formed in such a way that toward their boundary to the radiator network, the cross section increases most greatly over a relatively narrow space in comparison with other sections of the collar. This measure assures in an advantageous manner that a buckling and/or bending point within the scope of the manufacturing process is in fact positioned at the boundary between the shoulder and end-side section. Advantageously, the result is that the entire end-side section up to the shoulder or up to the boundary to the shoulder is inclined away.

In a first example embodiment, a shoulder contour can be made linear. Preferably, a shoulder contour can be disposed at a right angle to an edge of the near-bottom section. This type of shoulder contour can be realized especially simply with the aforementioned advantages according to the concept the invention.

In a second example embodiment, a shoulder contour can have a groove. It has proven advantageous that a shoulder contour is disposed at an acute angle to an edge of the near-bottom section. As a result, in an especially advantageous manner, the angle of an insertion taper can be determined by the formation of the groove, particularly by the formation of the acute angle. In the manufacturing process, the expansion angle of the insertion taper during bending or buckling of the end-side section is determined in that the latter is inclined away up to the contact with a groove flange forming the acute angle.

In a third example embodiment of the invention, a shoulder contour can be obliquely linear. It has proven advantageous in particular that a shoulder contour is disposed at an obtuse angle to an edge of the near-bottom section. This variant defines in a particularly advantageous manner a bending and/or buckling point within the scope of the manufacturing process.

A shoulder contour in another embodiment of the invention can basically also be curved. The shoulder contours that can be realized within the scope of a spline fitting have proven especially advantageous. In other words, a shoulder contour can be approximated as a higher order polynomial in an especially advantageous manner. It has also proven advantageous that an edge of the near-bottom and/or end-side section is made largely linear. It turned out that as a result the disadvantages of the conventional art are avoided in an especially advantageous manner. In other embodiments, a plurality of shoulders can be provided, for example, two or more shoulders between an end-side section and a near-bottom section. If necessary, the transition between a near-bottom section and an end-side section can thus be matched in a graduated way to the intended application.

The shoulder can be formed as part of a transition section, whereby the transition section has a transition from the shoulder to the near-bottom section and a transition from the shoulder to the end-side section. It turned out that according to the aforementioned refinement a transition to the shoulder can be made matched to the intended application and so that the buckling and/or bending behavior at a transition to the shoulder can be advantageously influenced. Thus, a transition, particularly a transition from the near-bottom section to the shoulder, can be made right-angled or obtuse-angled or acute-angled. A transition to the shoulder can also be made continuous or discontinuous as needed. Thus, it has proven advantageous to make both transitions continuous or both transitions discontinuous. It can also be advantageous to make a transition from the near-bottom section to the shoulder continuous and a transition from the end-side section to the shoulder discontinuous. Conversely, it can be advantageous to make a transition from the near-bottom section to the shoulder discontinuous and a transition from the end-side section to the shoulder continuous.

These modified refinements, not explained in detail here, within the scope of the concept of the invention have proven especially advantageous for application in a collar, which is oriented toward the block, in particular toward a radiator network structure.

The concept of the invention can be used basically for tubes of any cross section. The concept of the invention has proven especially effective in a flow channel as a flat tube with a tube narrow side and a tube wide side, for example, with a rectangular, or rectangular with a curved tube narrow side, or oval cross-sectional shape.

In an embodiment of the invention, the concept explained above can be combined with a refinement according to which the through opening, particularly the collar, can have at least one boundary contour arching away from a plane substantially perpendicular to the tube axis direction and running at a distance to the plane.

A heat exchanger according to the concept of the invention can be formed basically in numerous ways. The block can have a chamber which accommodates the flow channels and through which the second fluid can flow. Advantageously, the box is provided further with a cover, whereby the cover is mounted on the base. In addition or alternatively, the base can be made integral with the box.

It turned out further that the concept of the invention is especially effective for corner tubes and/or for tubes disposed in an edge region of a block.

The invention has proven especially advantageous, for example, with respect to heat exchangers as so-called tube-corrugated fin systems. For this purpose, a flow channel can have a heat-conducting member in the form of an inner fin attached, for example, soldered, to an inner channel surface and/or a heat-conducting member in the form of an outer fin attached, for example, soldered, to an outer channel surface. The fins are also called corrugated fins. The block can have in addition a flow guidance device, such as a turbulence device. In an embodiment, a so-called radiator network is formed as part of the block made of an alternating superposing of tubes and heat-transferring corrugated fins.

The invention leads in an especially preferred manner to a heat exchanger in the form of a direct or indirect charge air heat exchanger, for example, a radiator, or in the form of an exhaust gas heat exchanger, such as a radiator.

The concept of the present invention can be used in an especially preferred manner within the scope of the use of the heat exchanger of the aforementioned type for an internal combustion engine of a motor vehicle, therefore very generally in the mobile sector.

Whereas the invention proves to be especially useful for use of the heat exchanger according to the aforementioned type and is to be understood in this sense and whereas the invention will be described hereinafter in detail using examples from the mobile sector, it should nevertheless be clear that the concept described here, as claimed, is also useful within the scope of non-mobile applications or in applications in the mobile sector that are not specifically claimed here and are useful outside the fields explicitly cited here. For example, the presented concept can also be used for a heat exchanger as an auxiliary heater for the interior heating of a motor vehicle or as an oil cooler, particularly for cooling of motor oil and/or transmission fluid, or as a coolant cooler or coolant condenser in a coolant circuit of a motor vehicle air conditioning unit.

Exemplary embodiments of the invention will now be described hereinafter using the drawing in comparison with the state of the art, which is also shown in part. It should depict the exemplary embodiments but not to scale; rather the drawing, where helpful for the explanation, is realized in schematicized and/or slightly distorted form. In regard to additions to the teaching discernible directly from the drawing, reference is made to the relevant state of the art. It must be taken into account here that numerous modifications and changes in regard to the form and details of an embodiment may be made without departing from the general idea of the invention. The features of the invention disclosed in the present description, in the drawing, and in the claims both individually and in any combination can be essential for the refinement of the invention. The general idea of the invention is not limited to the precise form or the detail of the embodiment shown and described hereinafter or limited to a subject matter that would be limited in comparison with the subject matter claimed in the claims. In the case of the indicated dimensioning ranges, values also within the indicated limits are to be disclosed as limit values and can be used and claimed as desired.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A heat exchanger according to the invention is realized according to an example embodiment in the form of a charge air cooler for direct charge air cooling and can be used for heat transfer between charge air and a coolant, such as air. In an alternative embodiment, the charge air cooler can be realized for indirect charge air cooling, whereby the coolant can be water. These and other heat exchangers can be used in particular for charge air cooling, or generally charge fluid cooling, in mobile applications, e.g., commercial vehicles. In the present case, the heat exchanger has a block comprising a radiator network for the separated heat-exchanging guiding of the charge air and the coolant. For this purpose, the block has a number of flow channels through which charge air can flow and which in addition have a heat-conducting member in the form of an inner fin attached to an inner channel surface and a heat-conducting member in the form of an outer fin attached to an outer channel surface. This type of arrangement usually having an alternating superposition of tubes and heat-transferring corrugated fins is also called a radiator network. A box flow-connected to the flow channels is assigned to the block, whereby a base is provided between the block and the box with one or more through openings for feeding through the flow channels between the block and the box.

Figure 1B:
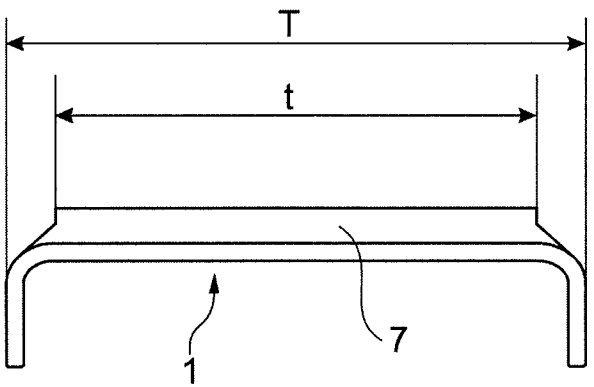
Fig. 1B CONVENTIONAL ART
FIGS. 1A-1B show an example of a base with a passage in a heat exchanger according to the state of the art, in a perspective view (FIG. 1A) and a side view (FIG. 1B)
Figure 1A:
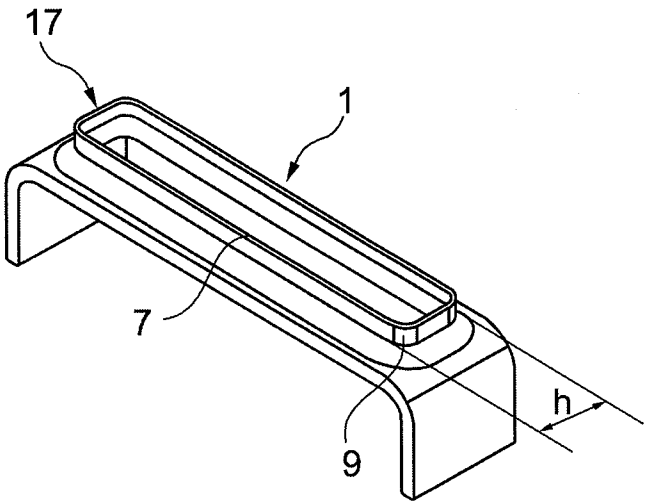
Fig. 1A CONVENTIONAL ART

A passage 17 placed in base 1 with collar 7 oriented toward the radiator network, as is shown in FIG. 1A and FIG. 1B, can be used primarily for mobile applications such as a charge air cooler for commercial vehicles. In this case, improvement of the force closure by reducing the so-called bottom projection, given as half the difference between tube depth t and base depth T in FIG. 1B, basically can also be used advantageously to increase the internal pressure fatigue strength. An option, described in German Patent Application No. DE 10 2007 059 673, which is herein incorporated by reference, and which is commonly owned by Applicant, for reducing the stresses in the area of transition 9 from the tube narrow side 13, shown in FIG. 2, to the tube wide side 15 can be achieved in that collar 7 has a boundary contour 19 arching away from a plane substantially perpendicular to tube axis direction 21 and running at a distance to the plane and at transition 9 between tube narrow side 13 and tube wide side 15, a distance value is selected smaller than a distance value at the tube wide side 15 in such a way that stresses in the area of transition 9 are reduced. This type of boundary contour can but need not be provided in all of the embodiments explained hereinafter.

Figure 2:
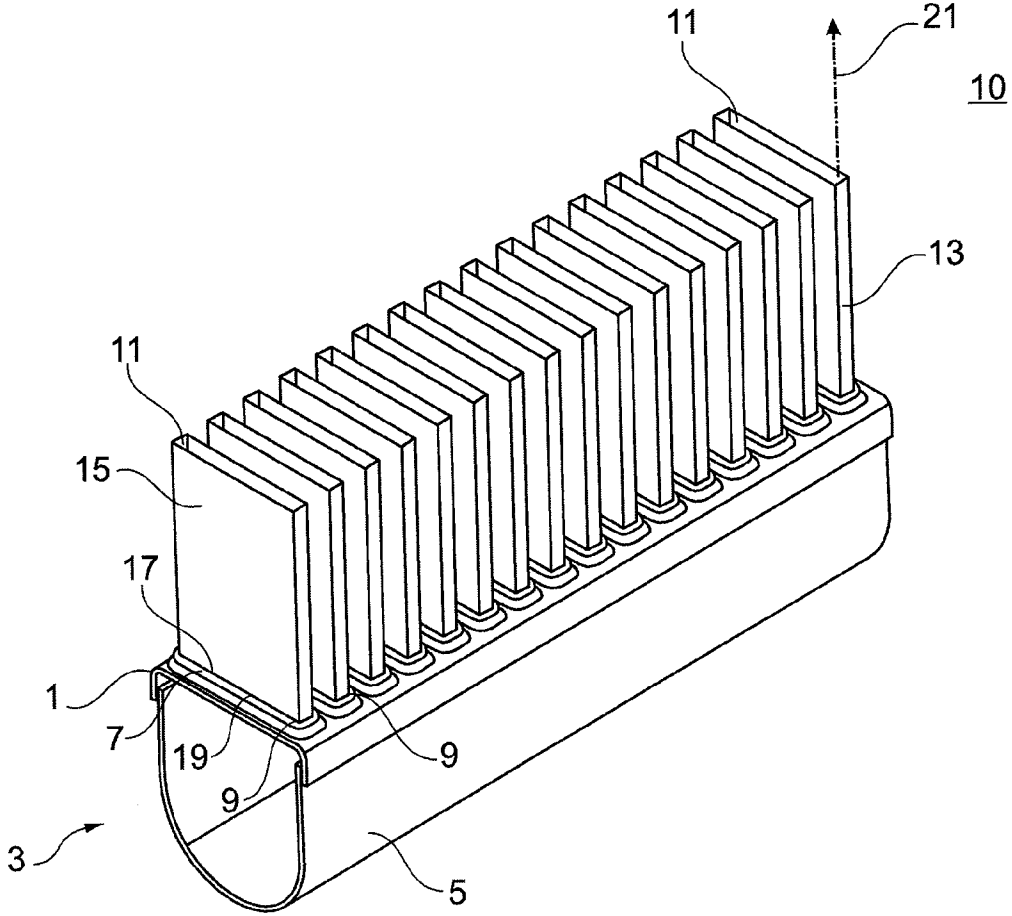
FIG. 2 shows a perspective depiction of a box with a base and inserted flat tubes in a heat exchanger in a perspective view.

Accordingly, an arrangement of a heat exchanger 10, not shown in greater detail, according to an embodiment of the invention is shown in a perspective view in FIG. 2. FIG. 2 shows in addition cover 5 of box 3, whereby cover 5 is mounted on the base 1. The base provides several through openings, described in greater detail in subsequent figures, which are provided for feeding through the flow channels between the block, not shown further, and box 3. As can be seen in FIG. 2, a flow channel is formed as a flat tube 11, whereby a flat tube 11 has a tube narrow side 13 and a tube wide side 15. In the embodiment of FIG. 2, a base 1 with one or more through openings each in the form of a passage 17 for accommodating a tube 11 is disposed at the tube ends of tube 11; these connect the block with header box 3 disposed on both sides of the block, only one of which is shown here.

Flat tubes can be provided in all embodiments. In the present case, a flat tube 11 can be made, for example, as a rectangular tube. Moreover, the cross section of a tube can be varied in another embodiment. Thus, a cross section can also be approximately rectangular, approximately oval, or, for example, also a rectangular cross section with a curved narrow side.

Tube base 1, shown as a detail in the following figures in view A and in view B, is shown in the area of the through opening, which is formed as a passage 17 with a collar 7 oriented toward the block. Collar 7 of the through opening is limited toward the block by a boundary contour 19, whereby boundary contour 19 can be straight or if necessary can be arched away from a plane substantially perpendicular to tube axis direction 21 and can run at a distance to the plane, as it is described, e.g., in the aforementioned German application No. DE 10 2007 059 673.

Figure 3A:
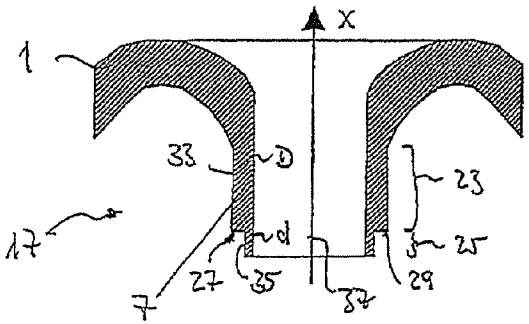
FIGS. 3A-3B show an example of a base with an "inverted" passage directed toward the radiator network according to the concept of the invention in an especially preferred first embodiment of a heat exchanger, whereby the passage area is shown in a side view with a collar with a stamped-in shoulder—in a first view before the realization of an insertion taper (FIG. 3A) and in a second view during the realization of an insertion taper with a punch (FIG. 3B)
Figure 3B:
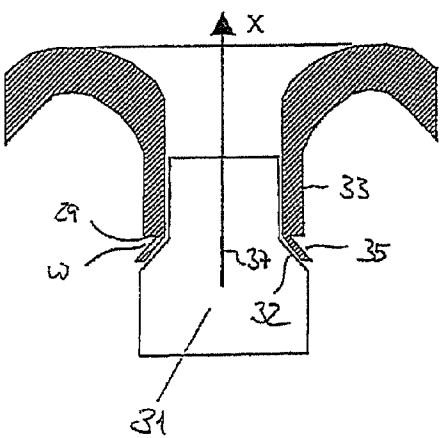

FIG. 3A shows collar 7 in a passage 17 of a base 1 in a state before the insertion taper is made by a punch 31 by "tuliping" within the scope of the manufacturing process, as shown in FIG. 3B. The blank of a base 1 of an embodiment, insofar as shown in the following figures in view (A), is fabricated for the finished base within the scope of the manufacturing step shown in views (B) of the following figures by "tuliping." In this case, identical features or parts and/or identical features or parts with the same function are given the same reference characters for the sake of simplicity.

Collar 7 of the embodiment in FIG. 3A and FIG. 3B, as in the other embodiments as well, according to the concept of the invention has a near-bottom section 23 and an end-side section 25, and between them a shoulder 27 with a shoulder contour 29 running transverse to contour 33 of near-bottom section 23 and/or transverse to contour 35 of end-side section 25. The shoulder in the present case is stamped in within the scope of the manufacturing process to form shoulder contour 29. According to the next manufacturing step shown in FIG. 3B, it permits the formation of shoulder 27 in which end-side section 25 inclines away from a passage axis 37. According to the concept the invention, it is possible because of shoulder 27 that, in one respect, passage 17 in the area of collar 7 can be made relatively long, on the one hand, and yet can be fabricated with a thin end-side section 25 to be buckled comparatively advantageously in the bending process shown in views (B) and with a near-bottom section 23, which is made relatively thick. Whereas contours 35, 33 of end-side section 25 and of near-bottom section 23 run parallel to one another before the "tuliping" step shown in FIG. 3B, they form an acute angle w after it. As is evident from FIG. 3A and FIG. 3B, as well as in other embodiments, according to the concept of the invention, a wall cross section d of end-side section 25 is smaller than a wall cross section D of near-bottom section 23. The design of stamped-in shoulder 27, shown in FIG. 3A, substantially determines the formation of the insertion taper defined more closely by the angle w. Accordingly, punch 31 has a conical widened area 32 suitable for forming the insertion taper.

Figure 4A:
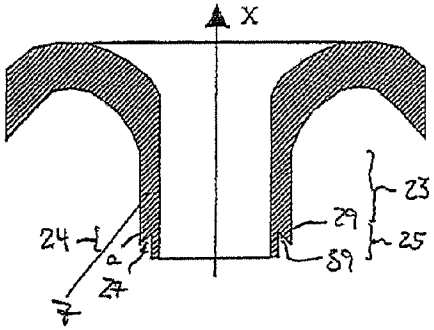
FIGS. 4A-4B show an example of a base with an "inverted" passage directed toward the radiator network according to the concept of the invention in an especially preferred second embodiment of a heat exchanger, whereby the passage area is shown in a side view with a collar with a stamped-in shoulder, which has a groove determining the angle of an insertion taper, —in a first view before the realization of an insertion taper (FIG. 4A) and in a second view during the realization of an insertion taper with a punch (FIG. 4B)
Figure 4B:
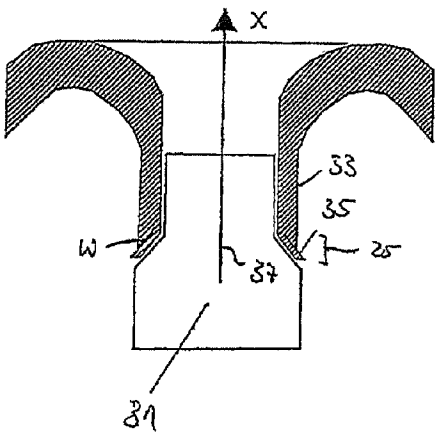

FIG. 4A and FIG. 4B show another example of a collar 7 in a passage 17, in which the stamped-in shoulder 27 is provided with a groove-like profile 39. In the present case, as in FIG. 3A and FIG. 3B, shoulder contour 29 is made linear, yet now shoulder contour 29 does not form a right angle to an edge 33, 35 of end-side section 25 or near-bottom section 23, but rather an acute angle a. Thus, in the state before the widening, the angle w of the insertion taper to passage axis 37 in shoulder 27 by stamping in of groove 39 is anticipated by the angle a. After the widening, as shown in FIG. 4B, the outwardly bent, relatively thin part of the collar in the form of end-side section 25 lies against this groove-like profile 39. In other words, in the present embodiment, shoulder contour 29 in the finished collar runs transverse to contour 33 of near-bottom section 23 but parallel to contour 35 of end-side section 25.

Figure 5A:
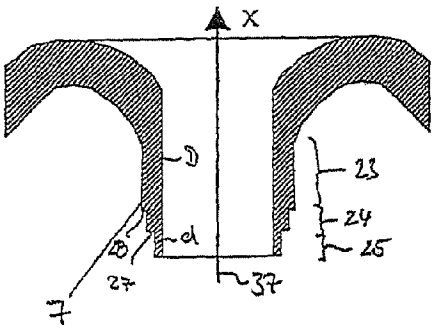
FIGS. 5A-5B show an example of a base with an "inverted" passage directed toward the radiator network according to the concept of the invention in an especially preferred third embodiment of a heat exchanger, whereby the passage area is shown in a side view with a collar with two stamped-in shoulders, whereby a cross section of a collar wall increases discontinuously in the direction of the radiator network—in a first view before the realization of an insertion taper (FIG. 5A) and in a second view during the realization of an insertion taper with a punch (FIG. 5B)
Figure 5B:
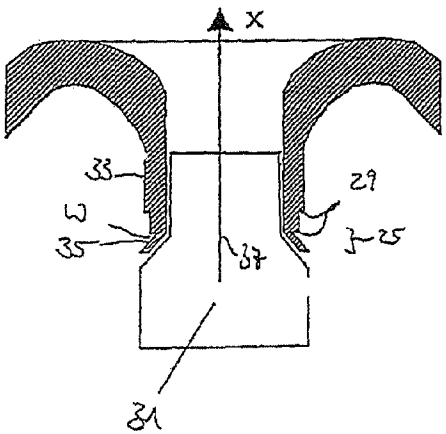

FIG. 5A and FIG. 5B show another example of a collar 7 in a passage 17, whereby in the present case a transition section 24 is formed between near-bottom section 23 and end-side section 25 and transition section 24 has two shoulders 27, 28. In turn, the wall thickness d of end-side section 25 is smaller than the wall thickness D of near-bottom section 23 and the wall thickness is widened stepwise in the direction of passage axis 37 by shoulders 27, 28. Whereas the present embodiment of FIG. 5A and FIG. 5B is shown with two shoulders 27, 28 in transition section 24, thus, a transition section 24 according to this principle of a refinement of the invention can be characterized very generally by a series connection of two or more, therefore virtually any number of cross-sectional jumps, which increase the wall thickness of the end-side section d stepwise, therefore discontinuously, to a wall thickness D of near-bottom section 23. FIG. 5B in turn shows the manufacturing step in which end-side section 25, similar to FIG. 3B, is bent by a punch 31 to form an insertion characterized by the angle w.

Figure 6A:
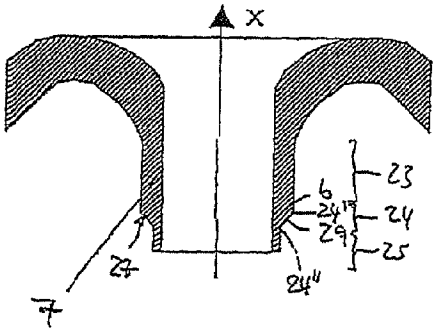
FIGS. 6A-6B show an example of a base with an "inverted" passage directed toward the radiator network according to the concept of the invention in an especially preferred fourth embodiment of a heat exchanger, whereby the passage area is shown in a side view with a collar with a sloping shoulder, whereby a course of a collar wall is discontinuous from and to the shoulder taper and a cross section of a collar wall increases discontinuously in the direction of the radiator network—in a first view before the realization of an insertion taper (FIG. 6A) and in a second view during the realization of an insertion taper with a punch (FIG. 6B)
Figure 6B:
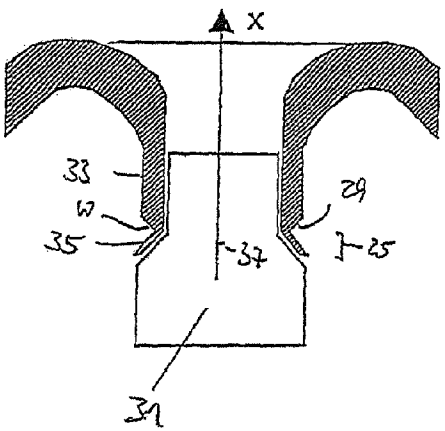

FIG. 6A and FIG. 6B show another example of a passage 17 with collar 7, in which the stamped-in shoulder 27 has a linear oblique shoulder contour 29, which, in contrast to the embodiment in FIG. 4A and FIG. 4B, in the present case has an obtuse angle b to the edge 33, 35 of a near-bottom section 23 or end-side section 25. Shoulder 27 in the present case is thereby part of a transition section 24 between end-side section 25 and near-bottom section 23, whereby a transition to shoulder 27, within the scope of transition section 24, is formed discontinuous, i.e., angled, on both sides, i.e., a transition to near-bottom section 23 and a transition to end-side section 25. FIG. 6B in turn shows the manufacturing step to bend end-side section 25 with a punch 31.

It is to be understood that shoulder contour 29 in the previously described embodiments can also be made essentially not linear but as curved as desired. Within the scope of embodiments not shown here, it has proven advantageous that a shoulder contour 29 can be made advantageously, for example, as a spline profile.

Figure 7A:
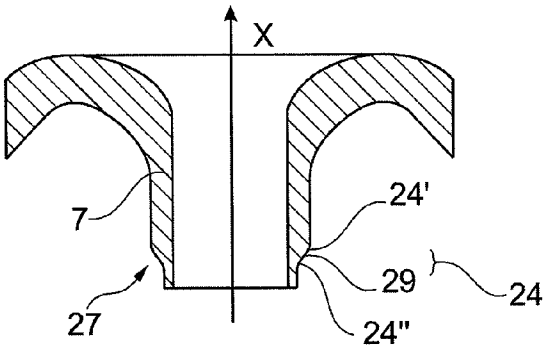
FIG. 7A-7B show an example of a base with an "inverted" passage directed toward the radiator network according to the concept of the invention in an especially preferred fifth embodiment of a heat exchanger, whereby the passage area is shown in a side view with a collar with a sloping shoulder, whereby a course of a collar wall is continuous from and to the shoulder taper and a cross section of a collar wall increases continuously in the direction of the radiator network—in a first view before the realization of an insertion taper (FIG. 7A) and in a second view during the realization of an insertion taper with a punch (FIG. 7B)
Figure 7B:
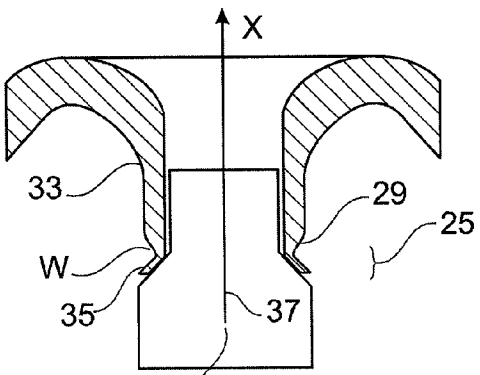

FIG. 7A and FIG. 7B show another example of a collar in a passage 17, in which, in the modification to FIG. 6A and FIG. 6B discussed above, shoulder contour 29 of shoulder 27 is again made largely linear, but transitions 24', 24" to shoulder contour 29 in the present case are made continuous on both sides, here rounded. The associated manufacturing step for bending an end-side section 25, as in the embodiments described heretofore, is shown in FIG. 7B.

Figure 8A:
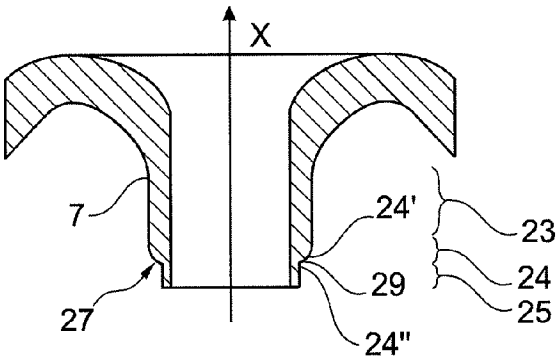
FIG. 8A-8B show an example of a base with an "inverted" passage directed toward the radiator network according to the concept of the invention in an especially preferred sixth embodiment of a heat exchanger, whereby the passage area is shown in a side view with a collar with a sloping shoulder, whereby a course of a collar wall is continuous from a shoulder taper and discontinuous to the shoulder taper and a cross section of a collar wall increases discontinuously in the direction of the radiator network—in a first view before the realization of an insertion taper (FIG. 8A) and in a second view during the realization of an insertion taper with a punch (FIG. 8B)
Figure 8B:
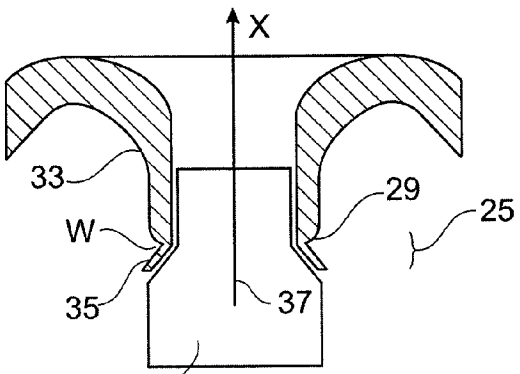

FIG. 8A and FIG. 8B show an example of a collar in a passage 17 with a near-bottom section 23, a transition section 24, and an end-side section 25, whereby transition section 24 has a shoulder 27 with a presently largely curved shoulder contour 29. The transition to the shoulder contour in the present case toward end-side section 25 is made as a discontinuous transition 24", therefore angular. The further transition from shoulder contour 29 to near-bottom section 23 in the present case is made continuous, here largely made curved in a convex way, as continuously curved transition 24'. The manufacturing step to bend end-side section 25 is in turn shown in FIG. 8B.

Figure 9A:
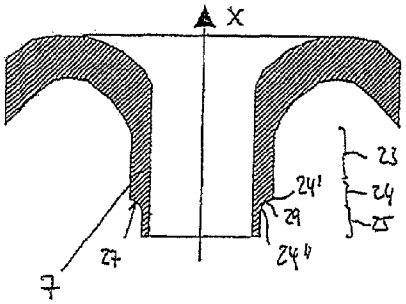
FIG. 9A-9B show an example of a base with an "inverted" passage directed toward the radiator network according to the concept of the invention in an especially preferred seventh embodiment of a heat exchanger, whereby the passage area is shown in a side view with a collar with a sloping shoulder, whereby a course of a collar wall is discontinuous from a shoulder taper and continuous to the shoulder taper and a cross section of a collar wall increases discontinuously in the direction of the radiator network—in a first view before the realization of an insertion taper (FIG. 9A) and in a second view during the realization of an insertion taper with a punch (FIG. 9B).
Figure 9B:
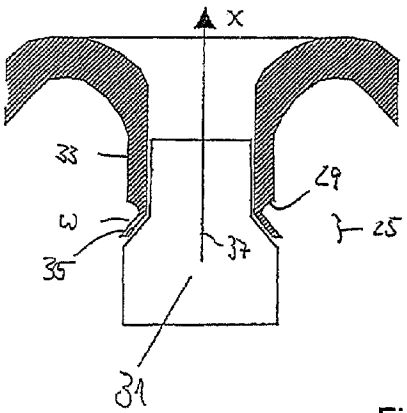

FIG. 9A and FIG. 9B show another example of a collar 7 in a passage 17 with an end-side section 25, a transition section 24, and a near-bottom section 23. Transition section 24 here has a shoulder 27, whose shoulder contour 29 within the scope of transition section 24 to near-bottom section 23 has a discontinuous transition 24' and to end-side section 25 a continuous transition 24", which in the present case is made concavely curved. In contrast to the embodiment shown in FIG. 8A and FIG. 8B, therefore, the continuous transition is disposed at the "lower" end of shoulder 27 and discontinuous transition 24' is disposed at the "upper" end of shoulder 27, whereas this is the converse in FIGS. 8A and 8B. It has proven advantageous in both embodiments, as in the embodiment of FIG. 7A and FIG. 7B, that for the largely continuous interpolation between transition 24' and/or transition 24", shoulder contour 29 is made as a spline with the lowest possible order. FIG. 9B in turn shows the manufacturing step to bend end-side section 25 with a punch 31 to form an insertion with the angle w to passage axis 37.

In summary, a heat exchanger 10 is provided for heat transfer between a first fluid, particularly charge air or an exhaust gas, and a second fluid, particularly a coolant, which has: a block for the separated and heat-exchanging guiding of the first and second fluid, the block which has a number of flow channels through which the first fluid can flow; at least one box 3 which is assigned to the block and which is flow-connected to the flow channels; and at least one base 1, which is provided with one or with more through openings for feeding through the flow channels between the block and the box 3, whereby at least one through opening is formed as a passage 17 with a collar 7. The invention provides that collar 7, on at least one side, has a near-bottom section 23 and an end-side section 25, whereby a wall cross section of end-side section 25 is smaller than a wall cross section of near-bottom section 23 and between near-bottom and end-side section 23, 25 at least one shoulder 27, 28 is disposed, which has a shoulder contour 29 running transverse to contour 33, 35 of near-bottom section 23 and end-side section 25; and whereby end-side section 25 is inclined away from a passage axis 37.

Overall, each of the previously described embodiments and other embodiments, not described in detail here and realizable within the scope of the invention, enable a simple and especially cost-effective manufacture of a base for a heat exchanger, in which, on the one hand, the strength for connecting the heat exchanger tubes is relatively high, and especially advantageous vis-à-vis DE 100 16 029 A1, and in which simultaneously the manufacture of radiator networks of the block of the heat exchanger with inverted passages 17 is possible with relatively high process security and therefore with relatively small reject rates.

From the aspect of strength, however, it is also not a disadvantage if the collar is as thin as possible overall. A thin collar has the advantage of being more flexible, when the network increases in width on one side, which is beneficial particularly for the alternating thermal loading capacity.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger for heat transfer between a first fluid and a second fluid, the heat exchanger comprising:

a block for separated and heat-exchanging guiding of the first and second fluid, the block having a plurality of flow channels through which the first fluid is flowable;

at least one box that is assigned to the block and that is flow-connected to the flow channels; and at least one base, which is provided with one or more through openings for feeding through the flow channels between the block and the box, at least one through opening being configured as a passage with a collar, wherein the collar is configured to mitigate damage due to thermal cycling, the collar having on at least one side a near-bottom section and an end-side section, wherein, between the near-bottom section and end-side section, at least one shoulder is disposed that has a shoulder contour forming an outer side surface of the collar, the outer side surface extending transverse to a passage axis of the openings, such that a wall thickness of the end-side section is smaller than a wall thickness of the near-bottom section, and wherein an outer edge of the shoulder is aligned with an outer edge of the near-bottom section, and wherein the end-side section is inclined away from the passage axis, such that outer edges of the end-side section extend outside of outer edges of the near-bottom section in the direction extending away from the passage axis.

2. The heat exchanger according to claim 1, wherein the collar is formed as a collar completely or only partially surrounding the through opening.

3. The heat exchanger according to claim 1, wherein at least one through opening in at least one edge and/or corner region of the base has the collar, or wherein all through openings have the collar.

4. The heat exchanger according to claim 1, wherein the transverse shoulder contour forms a predominant wall cross section difference between the near-bottom section and the end-side section.

5. The heat exchanger according to claim 1, wherein a discernible boundary between the shoulder and the end-side section defines a buckling and/or a bending point.

6. The heat exchanger according to claim 1, wherein a greatest change in the wall cross section occurs at a discernible boundary between the end-side section and the shoulder.

7. The heat exchanger according to claim 1, wherein an entire end-side section up towards the shoulder or up to a transition section is inclined away.

8. The heat exchanger according to claim 1, wherein a shoulder contour is disposed linearly to a contour of the near-bottom section or wherein the shoulder contour is disposed at a substantially right angle to the contour of the near-bottom section.

9. The heat exchanger according to claim 1, wherein a shoulder contour has a groove, particularly a shoulder contour at an acute angle to a contour of the near-bottom section.

10. The heat exchanger according to claim 1, wherein a shoulder contour is disposed obliquely linear, particularly a shoulder contour at an obtuse angle to a contour of the near-bottom section.

11. The heat exchanger according to claim 1, wherein a shoulder contour is curved, in particular is curved spline-like, and wherein a contour of the near-bottom and/or end-side section is linear.

12. The heat exchanger according to claim 1, wherein the shoulder is formed as part of a transition section, wherein the transition section has a transition from the shoulder to the near-bottom section and another transition from the shoulder to the end-side section.

13. The heat exchanger according to claim 1, wherein a transition from the near-bottom section to the shoulder, is right-angled or obtuse-angled or acute-angled.

14. The heat exchanger according to claim 1, wherein a transition to the shoulder is continuous or discontinuous.

15. The heat exchanger according to claim 1, wherein a transition from the near-bottom section to the shoulder is continuous and a transition from the end-side section to the shoulder is discontinuous, or wherein a transition from the end-side section to the shoulder is continuous and a transition from the near-bottom section to the shoulder is discontinuous.

16. The heat exchanger according to claim 1, wherein the collar is oriented toward the block and/or is oriented toward a radiator network structure.

17. The heat exchanger according to claim 1, wherein a flow channel is configured as a flat tube having a tube narrow side and a tube wide side, or wherein the flow channel has a cross-sectional shape formed to be rectangular, rectangular with a curved tube narrow side, or oval.

18. The heat exchanger according to claim 1, wherein the collar has at least one boundary contour arching away from a plane substantially perpendicular to the tube axis direction and running at a distance to the plane.

19. The heat exchanger according to claim 1, wherein the block has a chamber which accommodates the flow channels and through which a second fluid is flowable.

20. The heat exchanger according to claim 1, wherein the box has a cover configured to be mounted on the base, or where the base is formed integral with the box.

21. The heat exchanger according to claim 1, wherein a flat tube is disposed as a tube in an edge region or a corner region of the block and only these tubes are secured to a through opening made as a passage with a collar.

22. The heat exchanger according to claim 1, wherein the heat exchanger is configured as a direct or indirect charge air heat exchanger or a radiator.

23. The heat exchanger according to claim 1, wherein the heat exchanger is configured as a radiator.

24. Use of the heat exchanger according to claim 1 for an internal combustion engine of a motor vehicle.

25. A method for the manufacture of a heat exchanger, the method comprising:

providing a block for the separated and heat-exchanging guiding of the first and second fluid, said block having a plurality of flow channels through which the first fluid can flow;

providing at least one box that is assigned to the block and which is flow-connected to the flow channels;

providing at least one base, which is provided with one or more through openings for feeding through the flow channels between the block and the box, the through opening being formed as a passage with a collar;

configuring the collar to mitigate damage due to thermal cycling, such that the collar has a near-bottom section and an end-side section, wherein a wall thickness of the end-side section is smaller than a wall thickness of the near-bottom section;

disposing, between the near-bottom and the end-side section, at least one shoulder, which has a shoulder contour forming an outer side surface of the collar, the outer side surface extending transverse to a passage axis of the openings, such that a wall thickness of the end-side section is smaller than a wall thickness of the near-bottom section, and wherein an outer edge of the shoulder is aligned with an outer edge of the near-bottom section; and inclining the end-side section away from a passage axis, such that outer edges of the end-side section extend outside of outer edges of the near-bottom section in the direction extending away from the passage axis.

26. The method according to claim 25, wherein the shoulder is stamped in.

27. The heat exchanger according to claim 1, wherein a thickness of the end-side section is substantially constant along a length thereof, and a thickness of the near-bottom section is substantially constant along a length thereof.

28. The heat exchanger according to claim 1, wherein a width of the opening at the end-side section is greater than a width of the opening at the near-bottom section.

* * * * *